US010513859B2

(12) United States Patent
Ryan

(10) Patent No.: US 10,513,859 B2
(45) Date of Patent: Dec. 24, 2019

(54) CONCRETE FORM CONNECTOR ZIP RODS

(71) Applicant: Kevin Patrick Ryan, Zionsville, PA (US)

(72) Inventor: Kevin Patrick Ryan, Zionsville, PA (US)

(73) Assignee: Kevin P Ryan, Zionsville, PA (US)

( * ) Notice: Subject to any disclaimer, the term of this patent is extended or adjusted under 35 U.S.C. 154(b) by 0 days.

(21) Appl. No.: 15/939,339

(22) Filed: Mar. 29, 2018

(65) Prior Publication Data

US 2019/0301181 A1 Oct. 3, 2019

(51) Int. Cl.

| | |
|---|---|
| ***E04G 17/06*** | (2006.01) |
| ***E04G 17/075*** | (2006.01) |
| ***E04B 2/86*** | (2006.01) |

(52) U.S. Cl.

CPC ..... *E04G 17/0758* (2013.01); *E04B 2/8641* (2013.01); *E04B 2/8652* (2013.01); *E04B 2103/02* (2013.01); *E04G 2017/0638* (2013.01)

(58) Field of Classification Search

CPC ..... E04G 17/0758; E04G 2017/0638; E04B 2/8652; E04B 2/8641; E04B 2103/02

See application file for complete search history.

(56) References Cited

U.S. PATENT DOCUMENTS

| | | | | |
|---|---|---|---|---|
| 5,439,309 A * | 8/1995 | Raz | E04B 1/1903 | 403/316 |
| 6,151,856 A * | 11/2000 | Shimonohara | E04B 2/8635 | 52/309.12 |
| 2016/0168849 A1* | 6/2016 | Ryan | E04B 2/8641 | 52/404.2 |

* cited by examiner

*Primary Examiner* — Patrick J Maestri

(57) ABSTRACT

Plastic cross ties constructed of a plastic pipe with two separate connectors attached to both ends act as a unit to position opposing masonry shells as part of a stay-in-place concrete form system. A three part cross tie assembly constructed of a pipe and concrete from connectors are snapped together with zip rods eliminating the need for screwing, nailing or gluing.

4 Claims, 6 Drawing Sheets

CONCRETE FORM CONNECTOR ZIP RODS

FIELD OF THE INVENTION

The present invention relates to concrete forms and, more particularly, to masonry connector cross ties that position opposing masonry shells in a level and plumb manor for use as STAY-IN-PLACE form work. Plastic cross ties constructed of a plastic pipe with two separate connectors attached to both ends act as a unit to position opposing masonry shells as part of a stay-in-place concrete form system. The pipe and connectors are snapped together with zip rods through the pipe eliminating the need for screws, nails, or glue reducing the assembly time of the cross tie unit.

BACKGROUND OF THE INVENTION

Concrete wall construction is superior to wood stud wall construction by providing better fire resistance, higher strength against wind forces, and is more durable. However, concrete walls are unsightly, much harder to insulate, and form work costs are prohibitive.

A solution to the disadvantages of concrete wall construction over wood stud wall construction is illustrated and detailed in prior art documented in U.S. Pat. No. 9,388,574 patented Jul. 12, 2016 by Kevin Patrick Ryan—Stay In Place Concrete Form Connector.

In this prior art opposing masonry shells lined with vertical dovetail channels are spaced apart by plastic cross ties to form Stay-In-Place Concrete form work. The cross ties consist of a plastic pipe with two connectors attached on both ends of the pipe where the connectors are configured to engage the vertical dovetail channels molded into the masonry shells. This prior art addresses the disadvantages of concrete wall construction over wood stud wall construction as this type of construction is more easily insulated, is more attractive than an exposed concrete wall, and requires less form work labor as the masonry shell forms do not need to be removed.

Constructing a stay-in-place concrete form system is still more labor intense than constructing a wood stud wall system. To be competitive with wood stud wall construction any savings in labor time and cost would add to the justification for using this more expensive construction method.

In the prior art plastic cross tie units are created by fitting form connectors on both sides of a plastic pipe. The form connectors are then screwed or nailed to the plastic pipe to hold the pipe and the connectors together as one unit. Screwing or nailing the connectors together is a time consuming process making this stay-in-place concrete form system impractical.

It is therefore an objective of our invention to provide a mechanism of combining form connectors together with the plastic pipes that does not require screwing, nailing or gluing. A laborer in the field must be able to take a length of plastic pipe and snap a connector on both sides of the pipe without significant additional steps to create the cross tie assembly.

One possible solution to attach the connectors to the pipe would be to place a connector on both sides of the pipe and then thread a plastic cable tie strap through the pipe to hold the connectors from separating once snapped onto the ends of the pipe, creating a cross tie assembly with no screws, nails, or gluing. The concept of a tension strap that can be tightened easily but can not be easily withdrawn is illustrated and detailed in prior art documented in U.S. Pat. No. 3,118,200 patented Jan. 21, 1964 by Bell Charles Cox ET AL—Cable Strap. (commonly referred to as zip ties)

Cable Straps are flexible and only work when pulled through a female connector in tension. Creating a stiff rod instead of a strap would allow two opposing rods with ratcheting teeth to be pushed into a pipe from either end. The two sets of teeth would ratchet together when pushed past each other in compression but these teeth would be sloped such that withdrawal of the rods from the pipe would be resisted by the interlocking teeth.

It is therefore an objective of our invention to combine prior art invention, concrete form connector, with improvements to the concept of ratchet tension cable straps (also referred to as zip ties) to provide a stay-in-place concrete form cross tie assembly with snap together connectors using compression ratchet teeth rods crossing and engaging each other inside of a plastic pipe cross tie.

Prior art concrete form connectors require a laborer to interrupt assembly of the stay-in-place wall system to take time to nail or screw together cross tie assemblies, slowing down construction. As can be seen there is a need to snap together the cross tie assemblies quickly so that the laborer can concentrate on constructing the stay-in-place concrete form work.

SUMMARY OF THE INVENTION

In one aspect of the present invention, a method of connecting concrete form connectors in combination with a plastic pipe to create a cross tie assembly without the use of nails, screws or glue for use in a stay in place concrete form.

The plastic connectors are configured to fit tightly in a channel formed in masonry shells. The cross tie assembly and masonry shells are stacked to form a stay in place concrete form system.

The cross tie assembly consist of a plastic pipe and plastic connectors on both ends of the plastic pipe. The plastic connector has a plastic rod extending out from the mid height of the connector with ratchet teeth formed along the one side of the extended plastic rod. The plastic rod extension is configured to be inserted inside the plastic pipe and sized to fill half of the open area inside of the plastic pipe for the entire length of the pipe with the ratchet teeth facing the center of the pipe opening.

The plastic rod extension is configured with a cantilever spring arm extending down from the top of the rod extension. The ratchet teeth are molded in a position on the side of the cantilever spring arm. The cantilever spring arm allows the ratchet teeth to deflect inward away from the center of the pipe when forced inward by a pair of ratchet teeth passing each other with the teeth sloped in a manor to force the cantilever spring arm away from the center of the pipe. When the plastic rod extension is withdrawn from the pipe the ratchet teeth are sloped in a manor to allow the cantilever spring arm to return toward the center of the pipe locking two sets of mirrored ratchet teeth inter-meshed together preventing further withdrawal of the plastic rod extension.

Two identical dovetail plastic connectors with zip rod extensions are inserted into a plastic pipe, one from either end. The rod extensions cross as they are force toward each other through the pipe each filling opposite halves of the opening of the pipe. As the zip rods pass each other the cantilever spring arms with ratchet teeth are forced apart allowing the pairs of ratchet teeth to pass each other. As the zip rod extension are withdrawn the cantilever spring arms move back together locking the rod extensions together. The two dovetail plastic connectors and the plastic pipe are joined together to form a cross tie assembly.

DETAILED DESCRIPTION OF THE INVENTION

Figure 1:
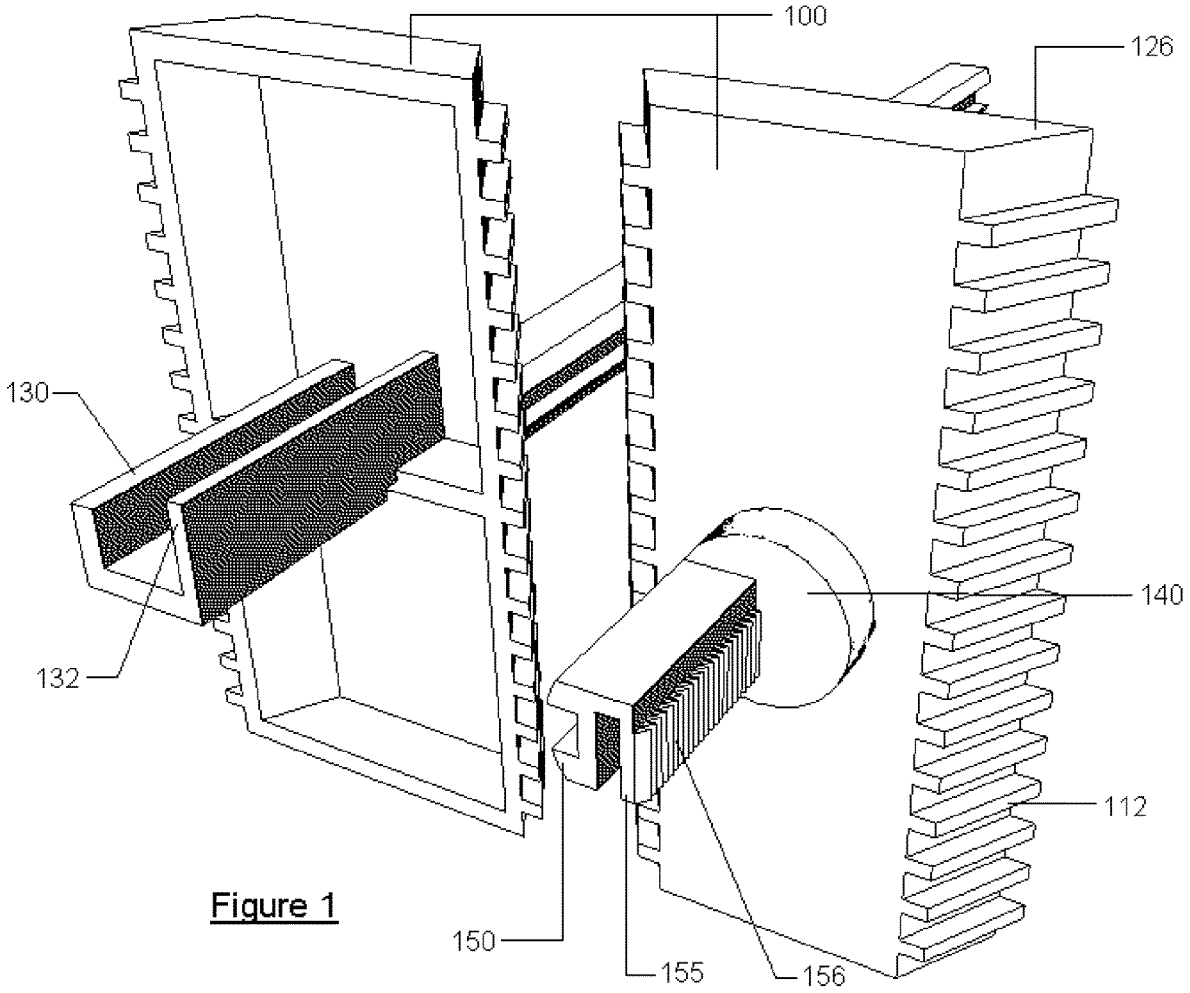
FIG. 1 is a back and front view of a pair of dovetail plastic connectors with the zip rod extension cut short for clarity.

The following detailed description is of the best currently contemplated modes of carrying out exemplary embodiment of the invention. The description is not to be taken in a limiting sense, but is made merely for the purpose of illustrating the general principles of the invention, since the scope of the invention is best defined by the appended claims.

Broadly, an embodiment of the present invention provides a mechanism to connect two concrete form connectors through a plastic pipe to create a stay-in-place concrete form cross tie assembly without the use of screws, nails or glue. The concrete form connectors are molded with an extension rod with ratchet teeth. The extension rods are sized to fit inside the plastic pipe with each rod filling half the area of the pipe opening. The extension rods are fashioned with cantilever spring arms with the ratchet teeth molding along the length of the spring arm. As two extension rods are inserted into the ends of the plastic pipe, one on each end, the spring arms are forced apart by the ratchet teeth passing in opposite direction sloped to force the spring arms apart. When the extension rods are pulled out of the plastic pipe the spring arms force the ratchet teeth together locking the assembly of two concrete form connectors and one plastic pipe into a cross tie assembly.

The cross tie assembly can then by used as part of a stay-in-place concrete form system constructed of masonry shells and plastic cross ties as documented in previous art.

The cross tie connectors come in three parts. The length of the plastic pipe can be modified as required to change the width of the concrete form opening. If the cross ties were formed as one piece then the width of the concrete form could not be easily modified. Combining the three parts as documented in previous art required screwing the three parts together.

Screwing, nailing, or gluing the three separate parts together is time consuming making the cost of this stay-in-place form system expensive.

One solution to resolve this problem would be to mold a ratchet cable tie as part of one of the two concrete form connectors. The second concrete form connector could then be molded with a female receptor to receive the ratchet cable tie. The ratchet cable tie could then be passed through the plastic pipe and then inserted and tightened to the second concrete form connector with a female receptor tensioning the two connectors and the plastic pipe together to form a cross tie connector assembly.

This solution is not practical as the ratchet cable tie is flexible and needs to be pulled trough the female receptor to tighten the parts together. A solution where ratchet teeth can connect parts together by pushing the parts together instead of pulling the end of a strap through a female receptor is ideal.

The present invention can ratchet together two sets or teeth by pushing two extension rods lined with ratchet teeth through a plastic pipe without the need for pulling the rods through a female receptor. The rods would be formed with cantilever spring arms that deflect in a manor enabling the ratchet teeth to pass each other when the rod is pushed into the plastic pipe, but the arms spring back to interlock the ratcheting teeth when the rods are withdrawn from the plastic pipe. The extension rods would be sized to fill half of the opening of the pipe. The pipe would confine the two rods together as they passed each other inside the pipe providing the force required to hold the ratcheting teeth together.

The three parts now joined together without the need for screws, nails, or glue could now be used as a cross tie assembly in a stay-in-place concrete form system using masonry shells lined with vertical dovetail channels.

Figure 6:
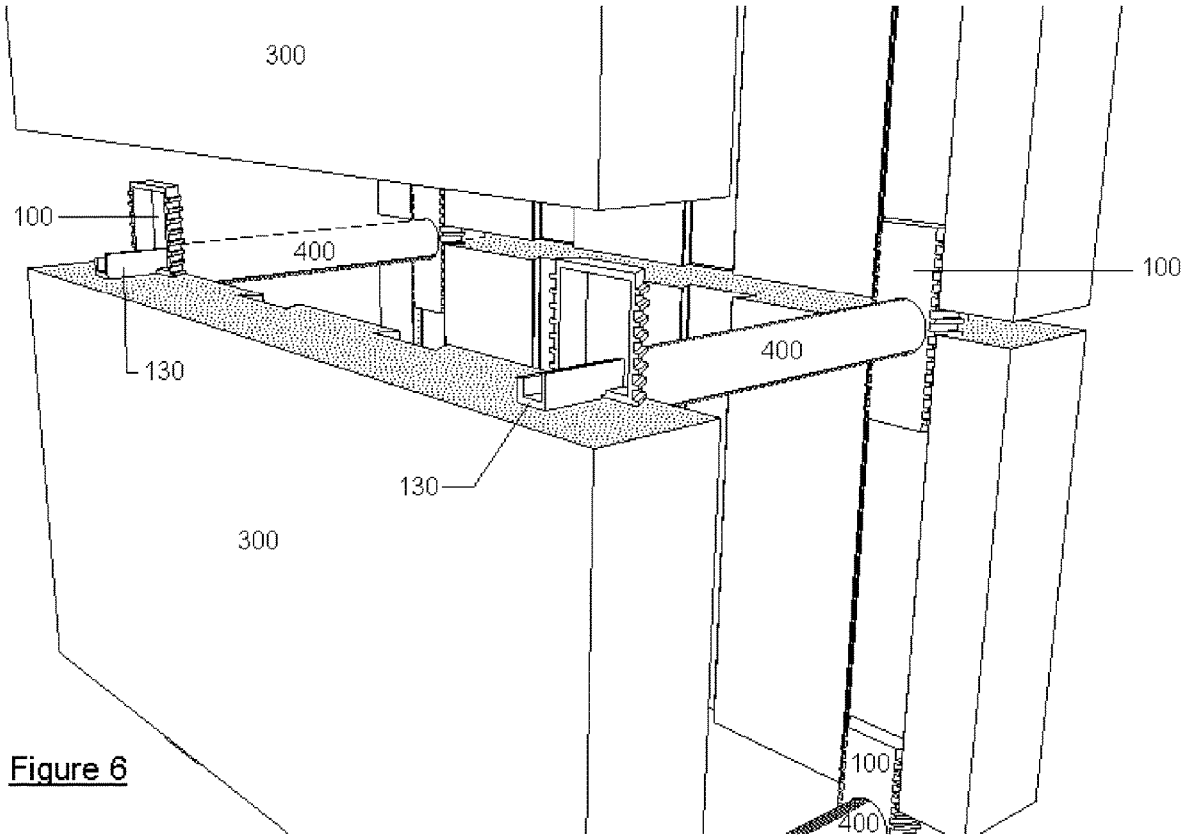
FIG. 6 is a isometric sectional view showing a step-wise construction of the present invention according to an exemplary embodiment of the present invention.

Referring now to the figures. a split plate metal mold with injection ports is manufactured to produce injection molded polypropylene parts 100 in the configuration shown in FIG. 1. This plastic part is configured into a dovetail shaped dowel 100 with a web shim guide protrusion 130 and a pipe receptor protrusion 140 with extension rod 150 to receive ½ inch diameter pvc pipe cross ties 400 as shown in FIG. 6. This configuration is the best currently contemplated configuration for carrying out exemplary embodiment of the invention.

The dovetail shaped concrete form connectors 100 act in pairs as a connector to join masonry shells of inconsistent dimensions 300 together for use as stay in place concrete form work as shown in FIG. 6.

Figure 2:
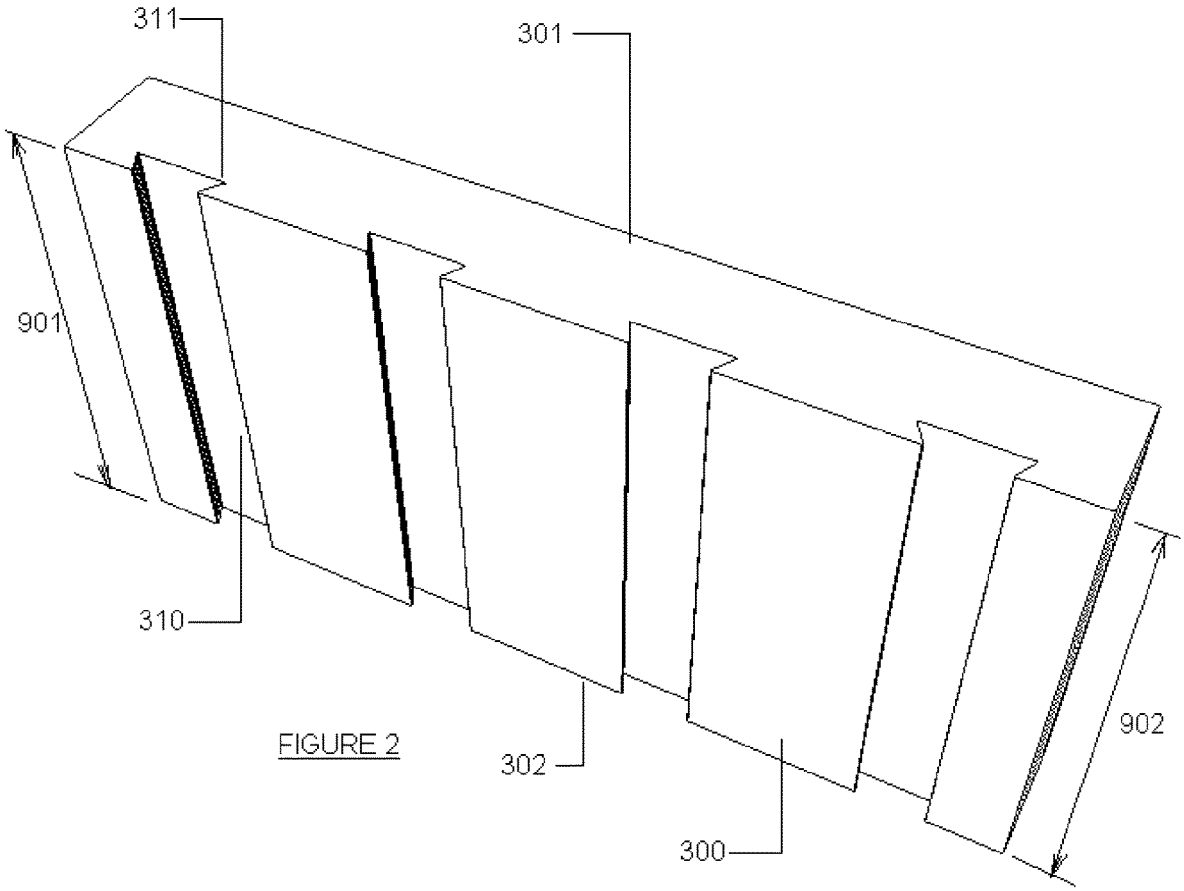
FIG. 2 is a side view of a masonry shell with vertical dovetail channels formed on the side used as the walls of a stay-in-place concrete form.

Referring now to FIG. 2, Masonry shells 300 are molded with vertical channels 310 spaced at equal spacing with a dovetail shape 311 that closely matches the shape of the dovetail dowel connector 100. Completed cross tie assemblies consisting of plastic pipe 400 and two concrete form connectors 100 are used to connect masonry shells 300 together as needed to form stay-in-place concrete form work as shown in FIG. 6.

Figure 3A:
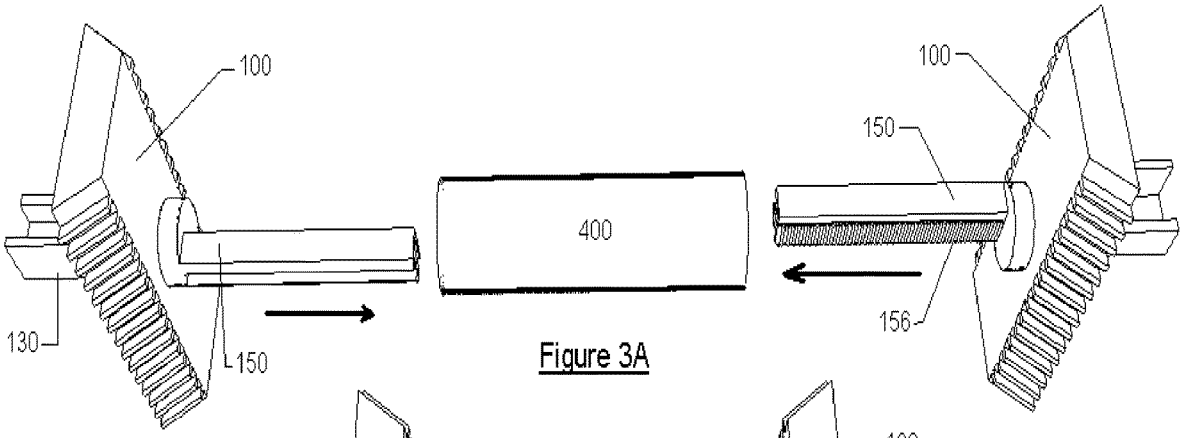
FIG. 3*a* is a top view of two concrete form connectors and a plastic pipe before being combined into a cross tie assembly.

Referring now to FIG. 3*a*, a pair of concrete form connectors 100 with zip extension rods 150 are shown prior to insertion into plastic pipe 400. The concrete form connectors are forced into both ends of plastic pipe 400 causing zip extension rods 150 to lap each other inside of the plastic pipe 400. Zip extension rods 150 have cantilever spring arms 155 molded along the adjacent sides of the zip extension rod 150. The cantilever spring arms 155 have ratchet teeth 156 position to interlock when a pair of extension rods 150 are inserted in opposite ends of a plastic pipe 400. The ratchet teeth 156 allow for insertion of the zip extension rods 150 but stop withdrawal of the zip extension rods 150 when the rods lap each other inside pipe 400.

Figure 3B:
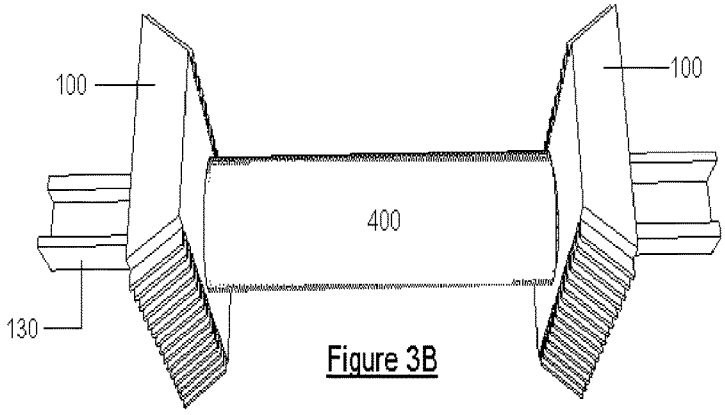
FIG. 3*b* is a top view of two concrete form connectors and a plastic pipe after being joined into a cross tie assembly.

Referring now to FIG. 3*b*, a pair of concrete form connectors 100 are shown in their fully inserted position inside plastic pipe 400.

Figure 4A:
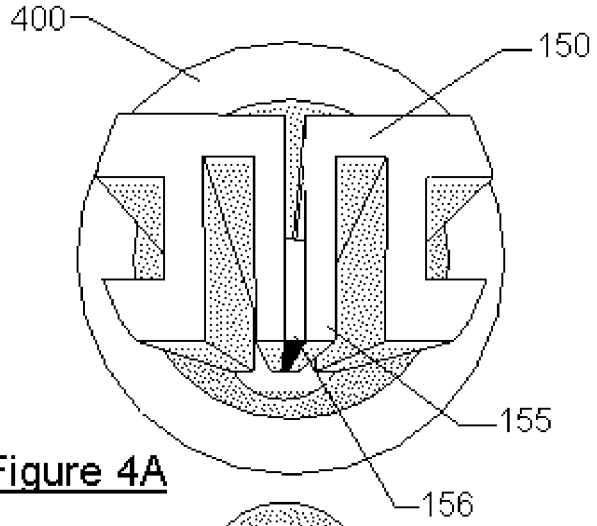
FIG. 4*a* is a cross section view of a cantilever spring arm positioned in its finished location after the cross tie assembly is combined.

Referring now to FIG. 4*a*, a cross section through plastic pipe 400 is shown with a pair of zip extension rods 150 inserted into the plastic pipe 400 in their final position as illustrated in FIG. 3*b*. Zip extension rod 150 is fashioned with cantilever spring arms 155 that is sized to deflect away from the center of the pipe when ratchet teeth 156 pass by each other during insertion of zip extension rod 150.

Figure 4B:
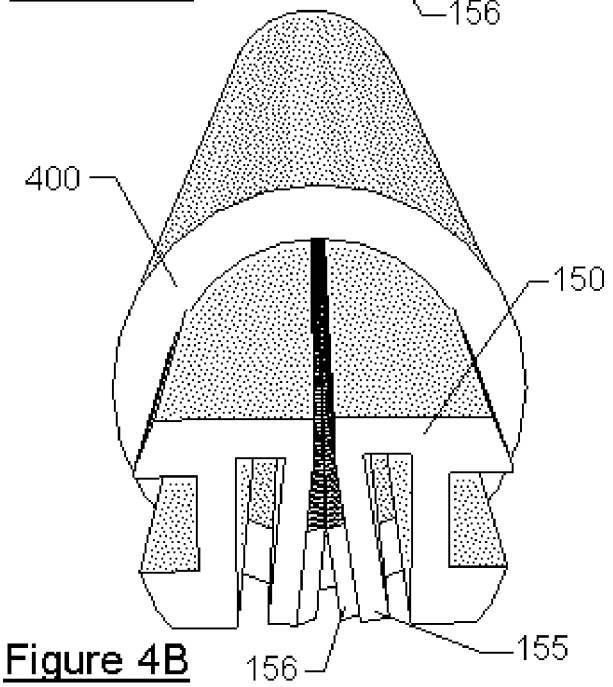
FIG. 4*b* is a cross section view of a cantilever spring arm deflected away from the center of the pipe during zip rod extension installation.

Referring now to FIG. 4*b*, a cross section through plastic pipe 400 is shown with cantilever spring arms 155 deflected away from the center of the pipe when ratchet teeth 156 pass by each other.

Figure 5:
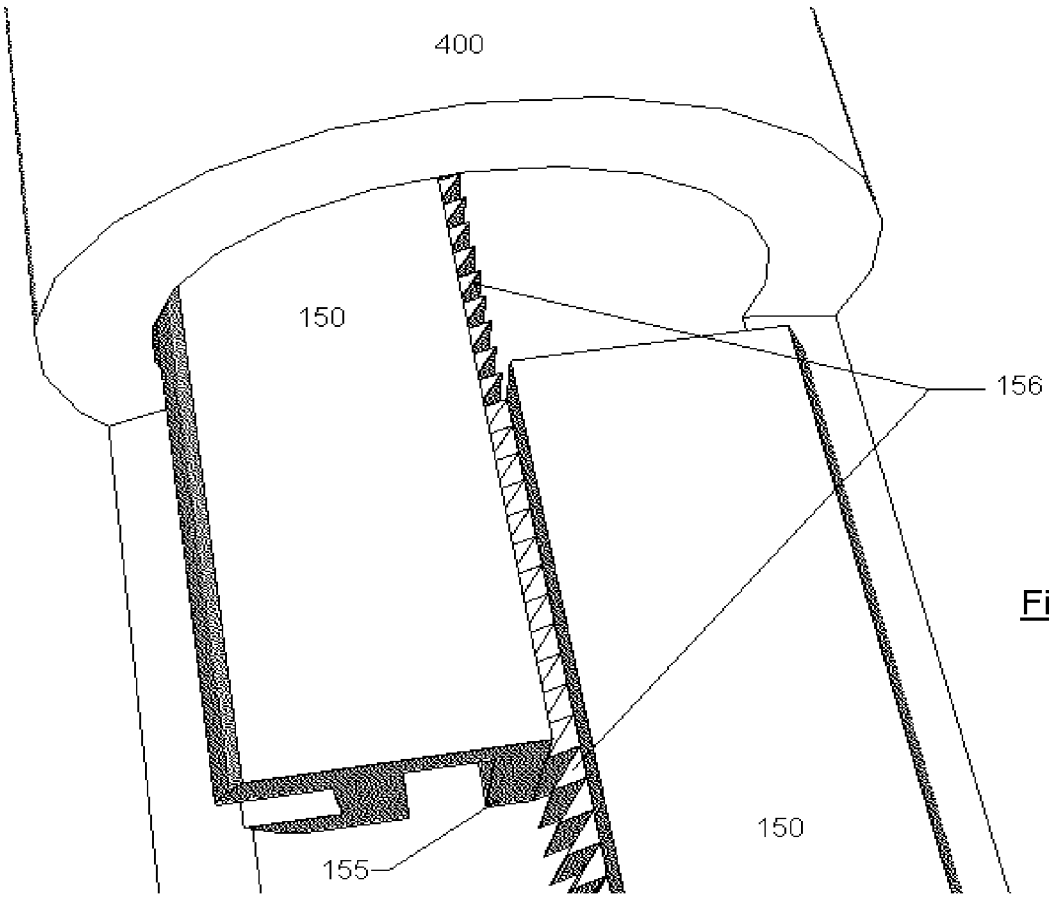
FIG. 5 is a top cut away view of the ratchet teeth interlocking during installation of the cross tie assembly.

Referring now to FIG. 5, a top cut away view of plastic pipe 400 is shown with a pair of zip extension rods 150 partially inserted into plastic pipe 400 illustrating how opposing ratchet teeth 156 interlock with each other when confined inside of plastic pipe 400 and when cantilever spring arm 155 has returned to its original position.

It should be understood, of course, that the foregoing relates to exemplary embodiment of the invention and that modifications may be made without departing from the spirit and scope of the invention as set forth in the following claims.

What is claimed is:

1. In masonry and concrete wall construction, a plastic tie system comprising: ties for interconnecting and immobilizing spaced apart form walls constructed of masonry unit shells, said ties each comprising a plastic tube, a length of the plastic tube cut to match a width of a space between spaced apart form walls and shaped to accept protrusion of opposing aligned plastic connectors to be permanently connected by interlocking said plastic connectors with protrusions within an open center in the plastic tube; each protrusion extending through the open center of the plastic tube and having elongated arm, an external surface of said arm extending down adjacent to an elongated arm extending down from a matching protrusion positioned from an opposite direction; said elongated arm having a plurality of ratchet teeth lining the elongated arm; said ratchet teeth sloped to interlock with a plurality of ratchet teeth lining an elongated arm of a matching protrusion positioned from an opposite direction.

2. The plastic tie system of claim 1 wherein said plastic connectors are sized and shaped to fit into vertical channels of said concrete masonry unit shell, multiple said plastic ties joining two concrete masonry unit shells into a masonry block.

3. The plastic tie system of claim 1 wherein a plurality of masonry blocks joined by a plurality of said plastic ties are stacked one on top of another to form a stay-in-place form system.

4. The form walls of claim 1 further comprising concrete poured in a central region between the pair of parallel, spaced apart form walls.

* * * * *